US009485815B2

(12) United States Patent
Zhang

(10) Patent No.: US 9,485,815 B2
(45) Date of Patent: Nov. 1, 2016

(54) BACKLIGHT DRIVING CIRCUIT AND LIQUID CRYSTAL DISPLAY WITH THE SAME

(71) Applicant: Shenzhen China Star Optoelectronics Technology Co., Ltd., Shenzhen, Guangdong (CN)

(72) Inventor: Xianming Zhang, Shenzhen (CN)

(73) Assignees: Shenzhen China Star, Shenzhen (CN); Optoelectronics Technology Co., Ltd, Guangdong (CN)

( * ) Notice: Subject to any disclaimer, the term of this patent is extended or adjusted under 35 U.S.C. 154(b) by 634 days.

(21) Appl. No.: 13/809,918

(22) PCT Filed: Dec. 25, 2012

(86) PCT No.: PCT/CN2012/087383

§ 371 (c)(1),
(2) Date: Jan. 14, 2013

(87) PCT Pub. No.: WO2014/094326

PCT Pub. Date: Jun. 26, 2014

(65) Prior Publication Data

US 2014/0167633 A1 Jun. 19, 2014

(30) Foreign Application Priority Data

Dec. 19, 2012 (CN) ..... 2012 1 0554022

(51) Int. Cl.
*H05B 33/08* (2006.01)

(52) U.S. Cl.
CPC ..... *H05B 33/0815* (2013.01)

(58) Field of Classification Search
CPC ..... H05B 33/0839; H05B 33/02; H05B 33/0815
USPC ..... 315/193
See application file for complete search history.

(56) References Cited

U.S. PATENT DOCUMENTS

| | | | | |
|---|---|---|---|---|
| 2004/0104775 | A1* | 6/2004 | Seremeta | 330/310 |
| 2006/0043911 | A1* | 3/2006 | Shao | H05B 33/0815 315/291 |
| 2010/0188007 | A1* | 7/2010 | Deppe | H05B 33/0809 315/224 |
| 2010/0237786 | A1* | 9/2010 | Santo et al. | 315/185 R |
| 2012/0075544 | A1* | 3/2012 | Sasaki | 349/42 |
| 2013/0088170 | A1* | 4/2013 | Lu | 315/307 |

* cited by examiner

*Primary Examiner* — Douglas Owens
*Assistant Examiner* — Jonathan Cooper
(74) *Attorney, Agent, or Firm* — Andrew C. Cheng

(57) ABSTRACT

A backlight driving circuit is disclosed. The backlight driving circuit includes a steady voltage circuit, a boost converter, a current setting circuit, and a control circuit. The steady voltage circuit receives an input voltage, filters the input voltage and outputs a steady DC voltage. The boost converter connects to the steady voltage circuit to receive the steady DC voltage. The control circuit provides a first PWM square wave such that the boost converter may supply power to the LED light bar. Wherein the boost converter includes a first MOSFET or a triode. At least three parallel connected resistors are arranged between a source of the first MOSFET or a collector of the triode and the ground, and the three resistors have the same or similar resistance. In addition, a liquid crystal display includes the backlight driving circuit is also disclosed.

13 Claims, 2 Drawing Sheets

BACKLIGHT DRIVING CIRCUIT AND LIQUID CRYSTAL DISPLAY WITH THE SAME

This application claims priority to China Patent Application No. 201210554022.3 filed on Dec. 19, 2012 entitled, BACKLIGHT DRIVING CIRCUIT AND LIQUID CRYSTAL DISPLAY WITH THE SAME, all of the disclosures of which are incorporated herein by reference in their entirety.

BACKGROUND OF THE INVENTION

1. Field of the Invention

Embodiments of the present disclosure relate to liquid crystal display technology, and more particularly to a backlight driving circuit and the liquid crystal display with the same.

2. Discussion of the Related Art

Boost converters or set-up converters are usually adopted in backlight driving circuits to provide direct current (DC) voltage to Light Emitting Diodes (LEDs).

As shown in FIG. 1, the boost converter indicated by the dashed lines includes a first inductance L1, a second diode D10, a resistor R10, a capacitor C1, and a Metal-Oxide-Semiconductor Field Effect Transistor (MOSFET) Q2. The driving chip provides pulse-width-modulated (PWM) signals to control the MOSFET Q2. Before the MOSFET Q2 is turn on, the capacitor C1 supplies power to the LED light bar, and a source of the second MOSFET Q2 is grounded via the resistor R10.

In addition, the boost converter further includes a current setting circuit. The current setting circuit includes a triode Q3, and resistors R1 and R2 connected in parallel are between a collector of the triode Q3 and the ground. The resistance value R of the resistors R1 and R2 is given by:

$$R=(R1*R2)/(R1+R2)$$

It can be seen that when the resistance value of R1 and R2 are different, the precision of the resistor may affect the resistance R when the resistor has a reduced resistance value. As such, the current precision is also affected. If the precision of each of the resistor is a %, when the resistance of one resistor is reduced for a %, the precision of the current may be reduced for an approximate amount equaling to a %.

SUMMARY

The object of the claimed invention is to provide a backlight driving circuit and a liquid crystal display for reducing the impact of resistors when setting current.

In one aspect, a backlight driving circuit includes: a steady voltage circuit for receiving an input voltage, filtering the input voltage and outputting a steady DC voltage; a boost converter connecting to the steady voltage circuit and to the positive end of a LED light bar, the boost converter receives the steady DC voltage, increases the DC voltage and outputs the DC voltage to the LED light bar; a current setting circuit connecting to a negative end of the LED light bar for setting a current of the LED light bar; a control circuit for providing a first pulse-width-modulated (PWM) square wave for the current setting circuit and providing a second PWM square wave for the boost converter; and wherein the current setting circuit includes a first MOSFET Q1 or a triode, at least three parallel connected resistors are arranged between a source of the first MOSFET or a collector of the triode and the ground, and the three resistors have the same or similar resistance.

Wherein the current setting circuit includes: a drain of the first MOSFET connects to the negative end of the LED light bar, at least three resistors are arranged between a source of the first MOSFET and the ground, and a gate of the MOSFET connects to the control circuit to receive the first PWM square wave for setting the current of the LED light bar.

Wherein the current setting circuit includes: an emitter of the triode connects to the negative end of the LED light bar, at least three parallel-connected resistors are arranged between a collector of the triode Q3 and the ground, the resistors have the same or similar resistance, and a base of the triode connects to the control circuit to receive the first PWM square wave for setting the current of the LED light bar.

Wherein the boost converter includes: a first inductance L1, a second diode D10, a second MOSFET, and a first capacitor C1 serially-connected in turn, a drain of the second MOSFET is connected between the first inductance L1 and the second MOSFET, and the first capacitor C1 is connected between a negative end of the diode D10 and the ground; and wherein a gate of the second MOSFET connects to the control circuit to receive the second PWM square wave, and a source of the second MOSFET is grounded via one resistor.

Wherein the boost converter includes: a first inductance L1, a second diode D10, a second MOSFET, and a first capacitor C1 serially-connected in turn, a drain of the second MOSFET is connected between the first inductance L1 and the second MOSFET, and the first capacitor C1 is connected between a negative end of the diode D10 and the ground; and wherein a gate of the second MOSFET connects to the control circuit to receive the second PWM square wave, and a source of the second MOSFET is grounded via one resistor.

Wherein the steady voltage circuit includes a second filter capacitor C2 connected between the input voltage and the ground.

Wherein the LED light bar includes a plurality of serially-connected LED light bars.

In another aspect, a backlight driving circuit includes: a steady voltage circuit for receiving an input voltage, filtering the input voltage and outputting a steady DC voltage; a boost converter connecting to the steady voltage circuit and to the positive end of a LED light bar, the boost converter receives the steady DC voltage, increases the DC voltage and outputs the DC voltage to the LED light bar; a current setting circuit connecting to a negative end of the LED light bar for setting a current of the LED light bar; a control circuit for providing a first PWM square wave for the current setting circuit and providing a second PWM square wave for the boost converter; and wherein the current setting circuit includes a first MOSFET, a drain of the first MOSFET connects to an negative end of the LED light bar, at least three resistors are arranged between a source of the first MOSFET and the ground, and a gate of the MOSFET connects to the control circuit to receive the first PWM square wave for setting the current of the LED light bar.

Wherein the boost converter includes: a first inductance L1, a second diode D10, a second MOSFET, and a first capacitor C1 serially-connected in turn, a drain of the second MOSFET is connected between the first inductance L1 and the second MOSFET, and the first capacitor C1 is connected between a negative end of the diode D10 and the ground; and wherein a gate of the second MOSFET connects to the control circuit to receive the second PWM square wave, and a source of the second MOSFET is grounded via one resistor.

Wherein the steady voltage circuit includes a second filter capacitor C2 connected between the input voltage and the ground.

Wherein the LED light bar includes a plurality of serially-connected LED light bars.

In another aspect, a liquid crystal display comprising a backlight driving circuit, the backlight driving circuit includes: a steady voltage circuit for receiving an input voltage, filtering the input voltage and outputting a steady DC voltage;

a boost converter connecting to the steady voltage circuit and to the positive end of a LED light bar, the boost converter receives the steady DC voltage, increases the DC voltage and outputs the DC voltage to the LED light bar; a current setting circuit connecting to a negative end of the LED light bar for setting a current of the LED light bar; a control circuit for providing a first PWM square wave for the current setting circuit and providing a second PWM square wave for the boost converter; and wherein the current setting circuit includes a first MOSFET Q1 or a triode, at least three parallel connected resistors are arranged between a source of the first MOSFET or a collector of the triode and the ground, and the three resistors have the same or similar resistance.

Wherein the current setting circuit includes: a drain of the first MOSFET connects to the negative end of the LED light bar, at least three resistors are arranged between a source of the first MOSFET and the ground, and a gate of the MOSFET connects to the control circuit to receive the first PWM square wave for setting the current of the LED light bar.

Wherein the current setting circuit includes: an emitter of the triode connects to the negative end of the LED light bar, at least three parallel-connected resistors are arranged between a collector of the triode Q3 and the ground, the resistors have the same or similar resistance, and a base of the triode connects to the control circuit to receive the first PWM square wave for setting the current of the LED light bar.

Wherein the boost converter includes: a first inductance L1, a second diode D10, a second MOSFET, and a first capacitor C1 serially-connected in turn, a drain of the second MOSFET is connected between the first inductance L1 and the second MOSFET, and the first capacitor C1 is connected between a negative end of the diode D10 and the ground; and wherein a gate of the second MOSFET connects to the control circuit to receive the second PWM square wave, and a source of the second MOSFET is grounded via one resistor.

Wherein the boost converter includes: a first inductance L1, a second diode D10, a second MOSFET, and a first capacitor C1 serially-connected in turn, a drain of the second MOSFET is connected between the first inductance L1 and the second MOSFET, and the first capacitor C1 is connected between a negative end of the diode D10 and the ground; and wherein a gate of the second MOSFET connects to the control circuit to receive the second PWM square wave, and a source of the second MOSFET is grounded via one resistor.

Wherein the boost converter includes: a first inductance L1, a second diode D10, a second MOSFET, and a first capacitor C1 serially-connected in turn, a drain of the second MOSFET is connected between the first inductance L1 and the second MOSFET, and the first capacitor C1 is connected between a negative end of the diode D10 and the ground; and wherein a gate of the second MOSFET connects to the control circuit to receive the second PWM square wave, and a source of the second MOSFET is grounded via one resistor.

DETAILED DESCRIPTION OF THE EMBODIMENTS

Embodiments of the invention will now be described more fully hereinafter with reference to the accompanying drawings, in which embodiments of the invention are shown.

Figure 1:
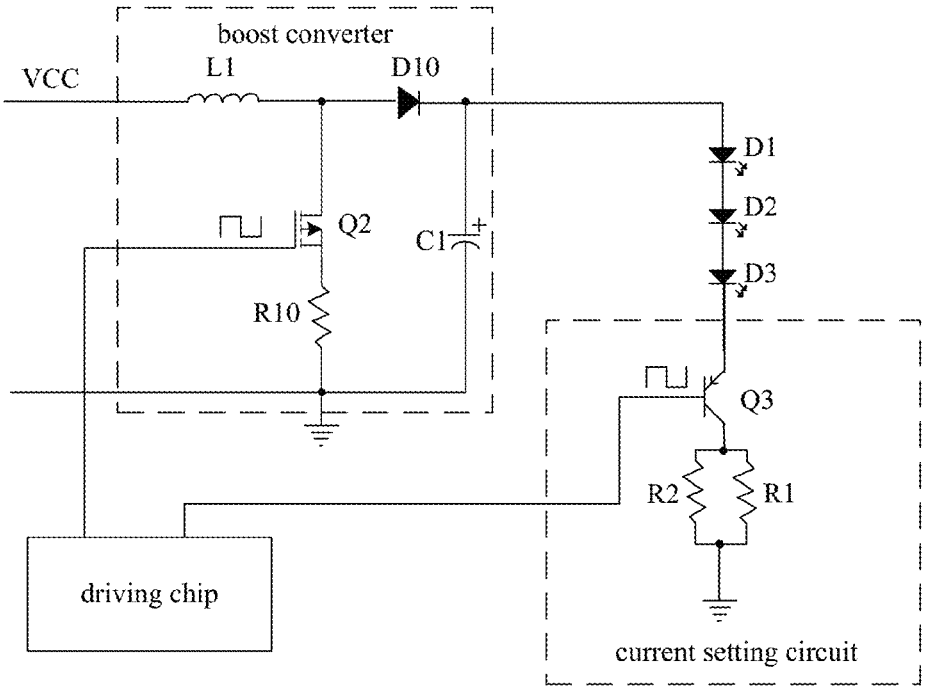
Figure 1 (Prior Art)
FIG. 1 is a schematic view of a typical backlight driving circuit.
Figure 2:
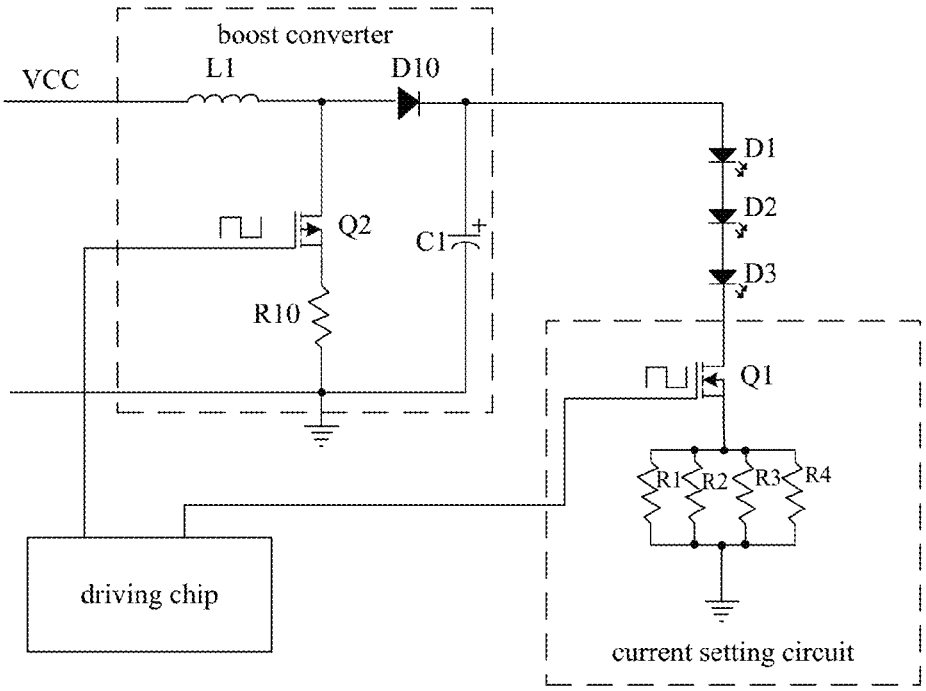
FIG. 2 is a schematic view of a backlight driving circuit in accordance with a first embodiment.

FIG. 2 is a schematic view of a backlight driving circuit in accordance with a first embodiment. The backlight driving circuit includes a steady voltage circuit, a boost converter, a current setting circuit, and a control circuit.

The steady voltage circuit filters an input voltage and then outputs a steady direct current (DC) voltage. The steady voltage circuit includes a second filter capacitor connected between the input voltage and the ground. The input voltage of the steady voltage circuit may be DC of 24V or 48V.

The boost converter connects to the steady voltage circuit and to the positive end of a LED light bar. The boost converter receives the steady DC voltage, increases the DC voltage, and outputs the DC voltage to the LED light bar.

The current setting circuit connects to a negative end of the LED light bar for setting the current of the LED light bar.

The control circuit provides a first PWM square wave for the current setting circuit and provides a second PWM square wave for the boost converter.

Specifically, the boost converter includes a first inductance L1, a second diode D10, a second MOSFET, and a first capacitor C1 connecting between the negative end of the diode D10 and the ground. A drain of the second MOSFET is connected between the first inductance L1 and the second MOSFET. The above components are serially-connected in turn. The positive end of the second diodes D1 connects with the first inductance L1.

The gate of the second MOSFET Q2 connects to the control circuit to receive the second PWM square wave controlling the power supply to the LED light bar. The drain of the MOSFET Q2 connects to the ground by the resistors R10.

As shown in FIG. 2, the negative end of the diode D1 connect to a plurality of serially-connected LED light bars (LED D1, D2, and D3). The number of the LED light bar, and the number of the LEDs of the light bar are not limited to the disclosure.

The input voltage is filtered by a second filter capacitor C2 to obtain a steady DC current. The first inductance L1 and the first capacitor C1 increase the voltage and control the second MOSFET Q2 by a duty cycle of second PWM square wave output from the control circuit. When the second MOSFET Q2 is turn on, the first capacitor C1 supplies voltage to the LED light bar. The voltage of the first capacitor C1 may be adjusted by changing the duty cycle of the second PWM square wave.

Specifically, the current setting circuit includes a first MOSFET Q1. The drain of the first MOSFET Q1 connects to the negative end of the LED light bar, and at least three resistors, having the same or similar resistance, are arranged between the source of the first MOSFET Q1 and the ground. As shown in FIG. 2, four resistors R1, R2, R3, and R4 are arranged between the source of the first MOSFET Q1 and the ground. The gate of the first MOSFET Q1 connects to the control circuit to receive the first PWM square wave for setting the current of the LED light bar. Specifically, the first MOSFET Q1 is controlled by adjusting the duty cycle of the first PWM square wave. When the first MOSFET Q1 is turn on, the parallel connected resistors R1-R4 divide the voltage for the LED light bar. The current for the LED light bar is adjusted by changing the resistance of the resistors R1-R4.

Figure 3:
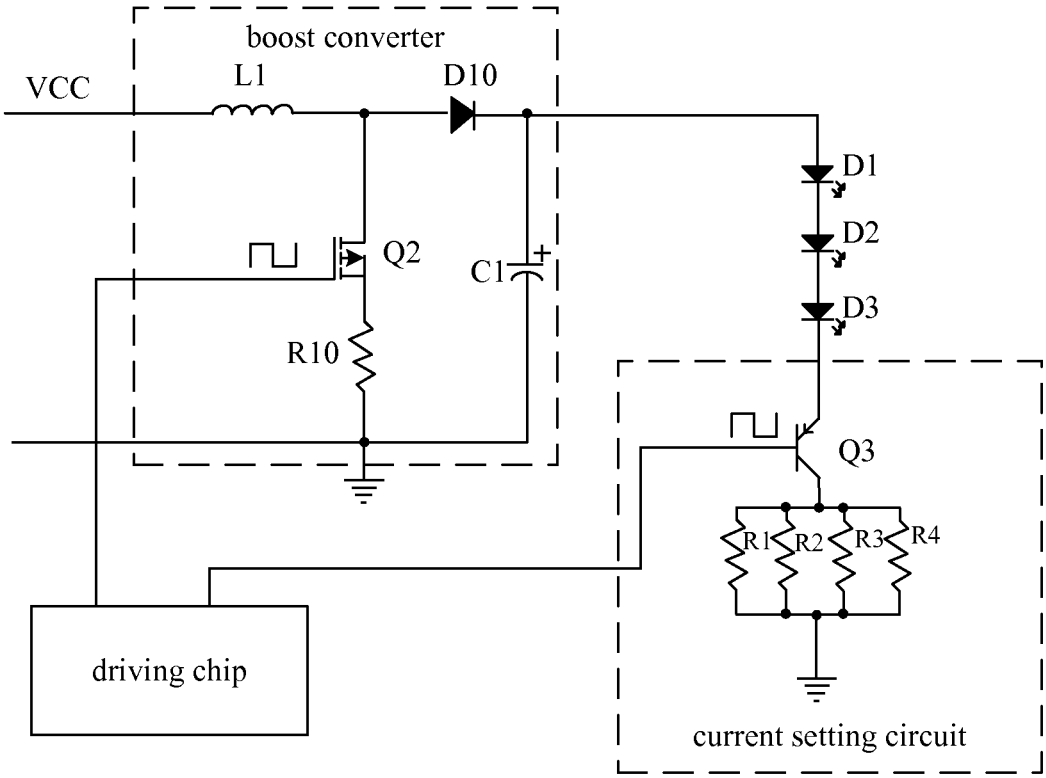
FIG. 3 is a schematic view of a backlight driving circuit in accordance with a second embodiment.

FIG. 3 is a schematic view of a backlight driving circuit in accordance with a second embodiment. It can be seen from FIG. 3 that the MOSFET Q1 in the first embodiment is replaced by a triode Q3. The current setting circuit includes the triode Q3. The emitter of the triode Q3 connects to the negative end of the LED light bar. At least three parallel connected resistors are arranged between the collector of the triode Q3 and the ground. The resistors have the same or similar resistance. The base of the triode Q3 connects to the control circuit to receive the first PWM square wave for setting the current of the LED light bar.

Similarly, the triode Q3 is controlled by adjusting the duty cycle of the first PWM square wave. When the triode Q3 is turn on, the parallel connected resistors R1-R4 divide the voltage for the LED light bar. The current for the LED light bar is adjusted by changing the resistance of the resistors R1-R4.

By connecting at least three parallel connected resistors with the same or similar resistance to the source of the MOSFET or the collector of the triode, the current precision of the LED light bar is enhanced. The example including four parallel connected resistors will be described hereinafter In the example, the resistance R is given by:

$$R=(R1*R2*R3*R4)/(R1+R2+R3+R4)$$

It can be seen from the above equation that the current precision may be enhanced because even though the resistance of one resistor is reduced for a %, the impact to the resistance R is only a/4%. That is to say the current precision may be reduced for a % only if the resistance of all of the resistors is reduced for a %. However, it is of low possibility that the above mentioned situation will happen. According to normal distribution, the probability that the resistance of the resistor is increased or is reduced is the same. Given the above equation, the sum of the increased amount and the reduced amount is zero. In this way, the probability that an error may occur is reduced to only ¼ so that the current precision is greatly enhanced.

In one embodiment, a liquid crystal display includes the backlight driving circuit as shown in FIG. 2 or 3.

It is believed that the present embodiments and their advantages will be understood from the foregoing description, and it will be apparent that various changes may be made thereto without departing from the spirit and scope of the invention or sacrificing all of its material advantages, the examples hereinbefore described merely being preferred or exemplary embodiments of the invention.

What is claimed is:

1. A backlight driving circuit, comprising:

a steady voltage circuit for receiving an input voltage, filtering the input voltage and outputting a steady DC voltage, and the steady voltage circuit comprises a second filter capacitor connected between the input voltage and the ground, the second filter capacitor is configured to filter the input voltage to obtain a steady DC current, the second filter capacitor connects to a boost converter to transmit the steady DC current to the boost converter;

the boost converter comprises a first inductance (L1), a diode (D10), a second MOSFET, and a first capacitor (C1) serially-connected in turn, the first inductance (L1) and the first capacitor (C1) increase the voltage, the second MOSFET is controlled by a duty cycle of a second pulse-width-modulated (PWM) square wave output from a control circuit, and the voltage of the first capacitor (C1) is configured in accordance with the duty cycle of the second PWM, the boost converter connecting to the positive end of a LED light bar, the boost converter receives the steady DC voltage, increases the DC voltage and outputs the DC voltage to the LED light bar;

a current setting circuit connecting to a negative end of the LED light bar for setting a current of the LED light bar;

a control circuit for providing a first PWM square wave for the current setting circuit; and wherein the current setting circuit includes a first MOSFET (Q1) or a triode, a drain of the first MOSFET connects to the negative end of the LED light bar, at least three parallel connected resistors are arranged between a source of the first MOSFET or a collector of the triode and the ground, a gate of the MOSFET connects to the control circuit to receive the first PWM square wave for setting the current of the LED light bar, and the three resistors have the same or similar resistance.

2. The backlight driving circuit as claimed in claim 1, wherein the current setting circuit comprises:

an emitter of the triode connects to the negative end of the LED light bar, at least three parallel-connected resistors are arranged between a collector of the triode (Q3) and the ground, the resistors have the same or similar resistance, and a base of the triode connects to the control circuit to receive the first PWM square wave for setting the current of the LED light bar.

3. The backlight driving circuit as claimed in claim 1, wherein:

a drain of the second MOSFET is connected between the first inductance (L1) and the second MOSFET, and the first capacitor (C1) is connected between a negative end of the diode (D10) and the ground; and wherein a gate of the second MOSFET connects to the control circuit to receive the second PWM square wave, and a source of the second MOSFET is grounded via one resistor.

4. The backlight driving circuit as claimed in claim 2, wherein:

a drain of the second MOSFET is connected between the first inductance (L1) and the second MOSFET, and the first capacitor (C1) is connected between a negative end of the diode (D10) and the ground; and wherein a gate of the second MOSFET connects to the control circuit to receive the second PWM square wave, and a source of the second MOSFET is grounded via one resistor.

5. The backlight driving circuit as claimed in claim 4, wherein the LED light bar comprises a plurality of serially-connected LED light bars.

6. A backlight driving circuit, comprising:

a steady voltage circuit for receiving an input voltage, filtering the input voltage and outputting a steady DC voltage, and the steady voltage circuit comprises a second filter capacitor connected between the input voltage and the ground, the second filter capacitor is configured to filter the input voltage to obtain a steady DC current, the second filter capacitor connects to a boost converter to transmit the steady DC current to the boost converter;

the boost converter comprises a first inductance (L1), a diode (D10), a second MOSFET, and a first capacitor (C1) serially-connected in turn, the first inductance (L1) and the first capacitor (C1) increase the voltage, the second MOSFET is controlled by a duty cycle of a second pulse-width-modulated (PWM) square wave output from a control circuit, and the voltage of the first capacitor (C1) is configured in accordance with the duty cycle of the second PWM, the boost converter connecting to the positive end of a LED light bar, the boost converter receives the steady DC voltage, increases the DC voltage and outputs the DC voltage to the LED light bar;

a current setting circuit connecting to a negative end of the LED light bar for setting a current of the LED light bar;

a the control circuit for providing a first PWM square wave for the current setting circuit; and wherein the current setting circuit comprises a first MOSFET, a drain of the first MOSFET connects to an negative end of the LED light bar, at least three resistors are arranged between a source of the first MOSFET and the ground, and a gate of the MOSFET connects to the control circuit to receive the first PWM square wave for setting the current of the LED light bar.

7. The backlight driving circuit as claimed in claim 6, wherein a drain of the second MOSFET is connected between the first inductance (L1) and the second MOSFET, and the first capacitor (C1) is connected between a negative end of the diode (D10) and the ground; and wherein a gate of the second MOSFET connects to the control circuit to receive the second PWM square wave, and a source of the second MOSFET is grounded via one resistor.

8. The backlight driving circuit as claimed in claim 7, wherein the LED light bar comprises a plurality of serially-connected LED light bars.

9. A liquid crystal display comprising a backlight driving circuit, the backlight driving circuit comprising:

a steady voltage circuit for receiving an input voltage, filtering the input voltage and outputting a steady DC voltage, and the steady voltage circuit comprises a second filter capacitor connected between the input voltage and the ground, the second filter capacitor is configured to filter the input voltage to obtain a steady DC current, the second filter capacitor connects to a boost converter to transmit the steady DC current to the boost converter;

the boost converter comprises a first inductance (L1), a diode (D10), a second MOSFET, and a first capacitor (C1) serially-connected in turn, the first inductance (L1) and the first capacitor (C1) increase the voltage, the second MOSFET is controlled by a duty cycle of a second pulse-width-modulated (PWM) square wave output from a control circuit, and the voltage of the first capacitor (C1) is configured in accordance with the duty cycle of the second PWM, the boost converter connecting to the positive end of a LED light bar, the boost converter receives the steady DC voltage, increases the DC voltage and outputs the DC voltage to the LED light bar;

a current setting circuit connecting to a negative end of the LED light bar for setting a current of the LED light bar;

a control circuit for providing a first PWM square wave for the current setting circuit; and wherein the current setting circuit includes a first MOSFET (Q1) or a triode, a drain of the first MOSFET connects to the negative end of the LED light bar, at least three parallel connected resistors are arranged between a source of the first MOSFET or a collector of the triode and the ground, a gate of the MOSFET connects to the control circuit to receive the first PWM square wave for setting the current of the LED light bar, and the three resistors have the same or similar resistance.

10. The liquid crystal display as claimed in claim 9, wherein the current setting circuit comprises:

an emitter of the triode connects to the negative end of the LED light bar, at least three parallel-connected resistors are arranged between a collector of the triode (Q3) and the ground, the resistors have the same or similar resistance, and a base of the triode connects to the control circuit to receive the first PWM square wave for setting the current of the LED light bar.

11. The liquid crystal display as claimed in claim 9, wherein the a drain of the second MOSFET is connected between the first inductance (L1) and the second MOSFET, and the first capacitor (C1) is connected between a negative end of the diode (D10) and the ground; and wherein a gate of the second MOSFET connects to the control circuit to receive the second PWM square wave, and a source of the second MOSFET is grounded via one resistor.

12. The liquid crystal display as claimed in claim 9, wherein the a drain of the second MOSFET is connected between the first inductance (L1) and the second MOSFET, and the first capacitor (C1) is connected between a negative end of the diode (D10) and the ground; and wherein a gate of the second MOSFET connects to the control circuit to receive the second PWM square wave, and a source of the second MOSFET is grounded via one resistor.

13. The liquid crystal display as claimed in claim 10, wherein:

a drain of the second MOSFET is connected between the first inductance (L1) and the second MOSFET, and the first capacitor (C1) is connected between a negative end of the diode (D10) and the ground; and wherein a gate of the second MOSFET connects to the control circuit to receive the second PWM square wave, and a source of the second MOSFET is grounded via one resistor.

* * * * *